United States Patent [19]

Fraser, Jr. et al.

[11] Patent Number: 4,511,314

[45] Date of Patent: Apr. 16, 1985

[54] MOUNTING FOR A HERMETIC COMPRESSOR

[75] Inventors: Howard H. Fraser, Jr., Lafayette; George A. Anderson, III, East Syracuse, both of N.Y.

[73] Assignee: Carrier Corporation, Syracuse, N.Y.

[21] Appl. No.: 609,616

[22] Filed: May 14, 1984

[51] Int. Cl.[3] ..... F25D 19/00

[52] U.S. Cl. ..... 417/363; 62/295; 384/257; 248/558; 248/580

[58] Field of Search ..... 62/295; 417/363; 248/558, 580; 384/257, 260

[56] References Cited

U.S. PATENT DOCUMENTS

| | | | |
|---|---|---|---|
| 2,857,746 | 10/1958 | Philipp | 62/295 |
| 2,894,678 | 7/1959 | Hintze | 230/58 |
| 2,935,279 | 5/1960 | LaPorte et al. | 62/295 |
| 2,965,289 | 12/1960 | Weibel, Jr. | 230/235 |
| 3,082,939 | 3/1963 | Warner | 230/235 |
| 3,486,687 | 12/1969 | Ayling | 417/363 X |
| 4,200,426 | 4/1980 | Linnert | 417/312 |

*Primary Examiner*—William E. Wayner
*Assistant Examiner*—John Sollecito
*Attorney, Agent, or Firm*—David J. Zobkiw

[57] ABSTRACT

In a compressor assembly, the motor compressor unit is vertically supported by lower bearing head which receives the crankshaft of the compressor. The lower bearing head is vertically supported by a positioning plate which is in turn vertically supported by a spring which is received in a recess in the casing. The mounting structure comprising the head, the plate and the spring coact to provide the sole vertical support of the motor compressor unit. This single vertical support is stable because the center of gravity of the compressor is coaxial with the centerline of the spring. The position plate may be rotated to accommodate compressors having different centers of gravity.

6 Claims, 6 Drawing Figures

MOUNTING FOR A HERMETIC COMPRESSOR

BACKGROUND OF THE INVENTION

In hermetic compressors the compressor assembly must be supported and positioned within the shell in a manner such that vibration is minimized so as to reduce noise and to protect the compressor from shocks in shipping and installation. Because available space is severely limited within the compressor shell and because the motor and compressor unit is asymmetrical, it is common practice to resiliently support the motor and compressor at several points. It has been standard practice to either individually design for each configuration or to over design the support and mounting structure. Also, the support structure has been located in the available, as opposed to the preferred, locations. In some configurations the cylinder block of the compressor coacts with the housing so that the compressor is supported directly by the housing, rather than by intermediate structure such as springs, and one or more degrees of freedom is limited.

SUMMARY OF THE INVENTION

An asymmetric hermetic compressor is stably supported within the compressor shell or casing by a mounting system. The mounting system includes a bottom mounting structure or assembly which includes a single open coil helical spring. More specifically, the bottom mounting structure includes the mounting spring, a positioning plate and a bearing housing support which coact to support the entire weight of the internal assembly such that the center of gravity of the compressor assembly, which is supported by the mounting spring, coincides with the geometric center of the mounting spring. This coaction eliminates any tilting of the compressor assembly and reduces stress on the other members making up the mounting system. The other members of the mounting system are the upper mounting assemblies which control the radial movement of the compressor, as at start up, and act as shipping stops. To a degree, the discharge line may be considered to act as a stiffener as the compressor moves drastically from its nominal position as at start up and in shipping. However, the bottom mounting structure or assembly supports the entire weight.

It is an object of this invention to eliminate any tilting of the compressor assembly and to reduce the stress on the other mounting supports.

It is another object to provide mounting structure which is equally suitable for two and four cylinder reciprocating hermetic compressors by using interchangeable parts.

It is a further object of this invention to use a single coil spring to stably support a hermetic compressor within its shell. These objects, and others as will become apparent hereinafter, are met by the present invention.

Basically, the motor and compressor assembly of a hermetic compressor are supported by a single open coil helical spring. The center of gravity of the compressor assembly and the geometric center of the spring coincide. In addition, the center line of the compressor, which is the center of rotation for the crankshaft, is within the area of the spring.

BRIEF DESCRIPTION OF THE DRAWINGS

For a fuller understanding of the present invention, reference should now be made to the following detailed description thereof taken in conjunction with the accompanying drawings wherein:

FIG. 2;

DESCRIPTION OF THE PREFERRED EMBODIMENT

Figure 1:
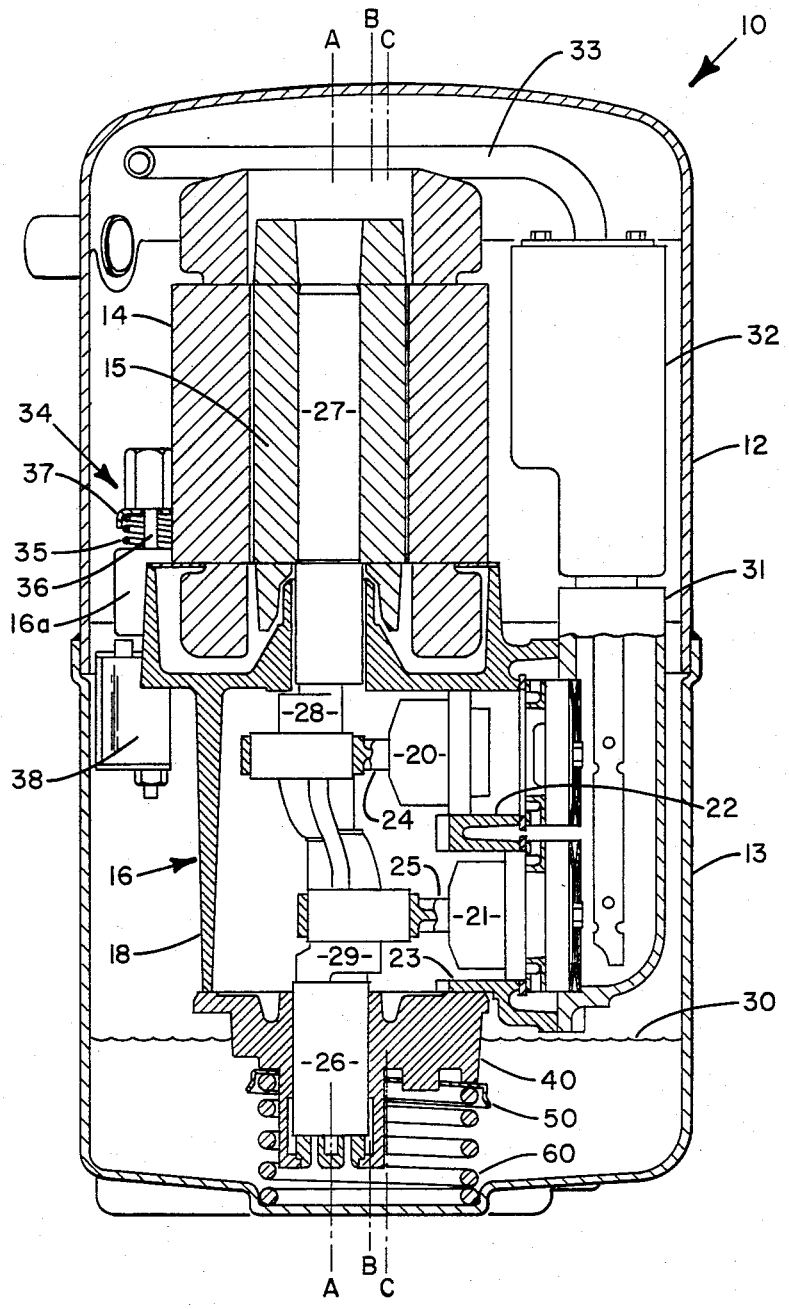
FIG. 1 is a vertical partially cutaway sectional view of a two-cylinder hermetic compressor employing the present invention.

In FIG. 1, the numeral 10 generally designates a vertical two-cylinder reciprocating hermetic compressor. Compressor 10 has a shell or casing made up of horizontally split sections 12 and 13 and includes motor 14 and compressor assembly 16. The compressor assembly 16 includes cylinder block 18 and pistons 20 and 21 which are slidably received in cylinders 22 and 23, respectively. The pistons 20 and 21 are operatively connected by connecting rods 24 and 25, respectively, to eccentric portions 28 and 29 of crankshaft 26. The crankshaft 26 is suitably rotatably journaled and rotor 15 of motor 14 is fixedly attached to the shaft section 27 of crankshaft 26.

In a conventional fashion, motor 14 causes crankshaft 26 to rotate and thereby cause the reciprocation of pistons 20 and 21. The reciprocation of pistons 20 and 21 causes refrigerant to be drawn into cylinders 22 and 23, respectively, through the corresponding suction valve structure where it is compressed. The compressed refrigerant is exhausted via the corresponding discharge valves, cylinder head 31, muffler 32, and discharge line 33.

The lower portion of the compressor assembly extends into lubricant reservoir 30 from which lubricant is drawn in a suitable conventional fashion. The upper mounting assemblies, typically, are made up of two identical diametrically opposed assemblies 34, only one of which is illustrated. The upper mounting assemblies 34 each include a coil spring 35 surrounding threaded mounting stud 36. The spring 35 is compressed between guide or retainer 37 and an ear **16*a* formed on compressor assembly and serves to provide a biasing force for properly positioning the compressor assembly. The threaded mounting stud 36 is fixedly retained by bracket 38** which is welded or otherwise suitably secured to the interior assembly described is conventional to this point.

Figure 2:
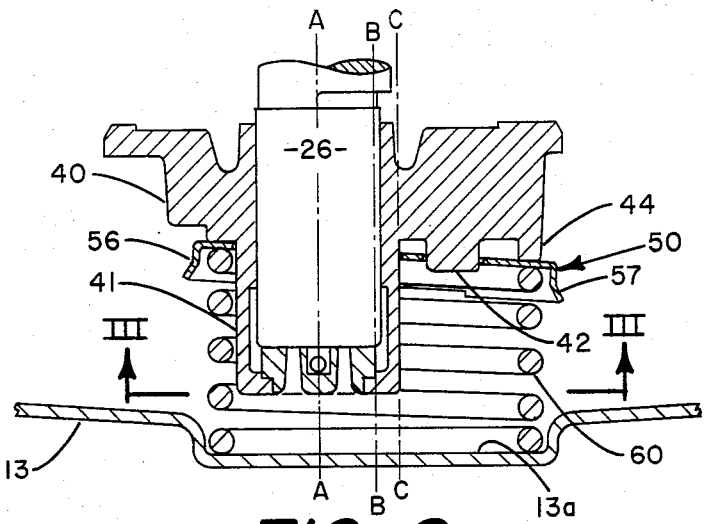
FIG. 2 is an enlarged partial sectional view of the mounting structure shown in an FIG. 1.
Figure 3:
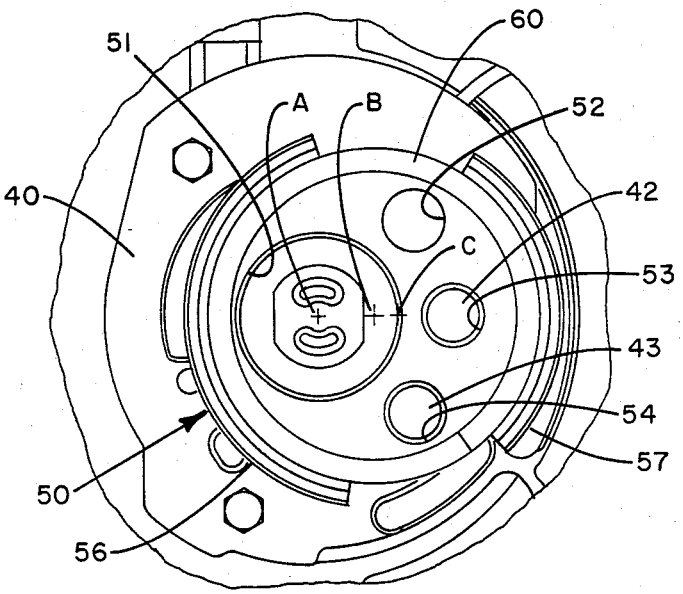
Figure 4:
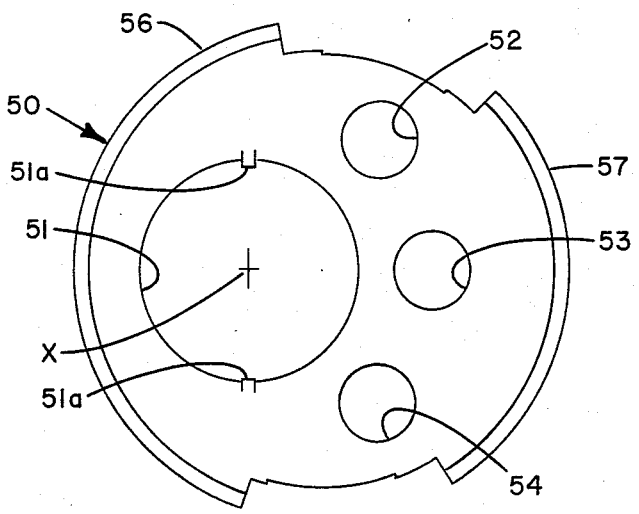
FIG. 4 is a bottom view of the positioning plate.

The lower end of crankshaft 26 is journaled in lower bearing head 40 and rotates about an axis.labeled A—A in FIGS. 1 and 2 and as A in FIG. 3. Referring now to FIG. 4, positioning plate 50 has a generally circular opening 51 formed therein whose center X coincides with point A of FIG. 3. Tabs **51*a* originally extend radially into opening 51 but are bent to hold plate 50 onto head 40 during assembly. In FIG. 4, one of the tabs 51*a* is shown bent and the other is shown unbent. Three openings, 52–54, are additionally provided in plate 50 with the centers of these openings being at equal distances from the center, X, of opening 51 and with openings 52 and 53 being separated by 45° and with openings 53 and 54 being separated by 45° whereby opening 53 is equally spaced from openings 52 and 54. The apex of the 45° angles is at X. Positioning plate 50 has two circumferentially spaced arcuate rim portions 56 and 57**.

Referring now to FIGS. 2 and 3, it is readily apparent that lower bearing head 40 has a tubular axial extension 41 and a pair of axially extending bosses 42 and 43 which are received in either openings 52 and 53, respectively, or openings 53 and 54, respectively. Bearing head 40 also has generally arcuate, axially extending rim sections 44 which coact with plate 50 for guiding spring 60 during assembly. In the configuration of FIGS. 1–3, extension 41 is received in opening 51 and bosses 42 and 43 are received in openings 53 and 54, respectively. By having plate 50 at an angle, it is possible to reduce the size of the spring required. One end of spring 60 is received in a recess 13*a* formed in casing section 13 and the other end engages plate 50 and is received in the recess formed by rim portions 56 and 57. The centerline of spring 60 and the center of gravity of the compressor assembly 16 are the same and are labeled B—B on FIGS. 1 and 2 and as B in FIG. 3. The centerline of the shell or casing is labeled C—C on FIGS. 1 and 2 and as C in FIG. 3.

As is best shown in FIG. 3, A, the centerline of the compressor and axis of rotation of crankshaft 26, B, the geometric center of the spring 60 and center of gravity of compressor assembly 16 and C, the geometric center of the shell or casing, all fall within the area defined by spring 60 and are all in essentially the same plane. Since the only movement is the rotation of the crankshaft 26 and the resultant movement of the eccentrics 28 and 29, connecting rods 24 and 25, and pistons 20 and 21, the axis A—A, B—B, and C—C remain within the area defined by spring 60. The corresponding symmetrical or paired movement of the various moving parts does not result in any significant instantaneous changes in the center of gravity due to this movement. As a result, axis B remains the center of gravity for all positions of the operating components of the compressor assembly 16.

Figure 5:
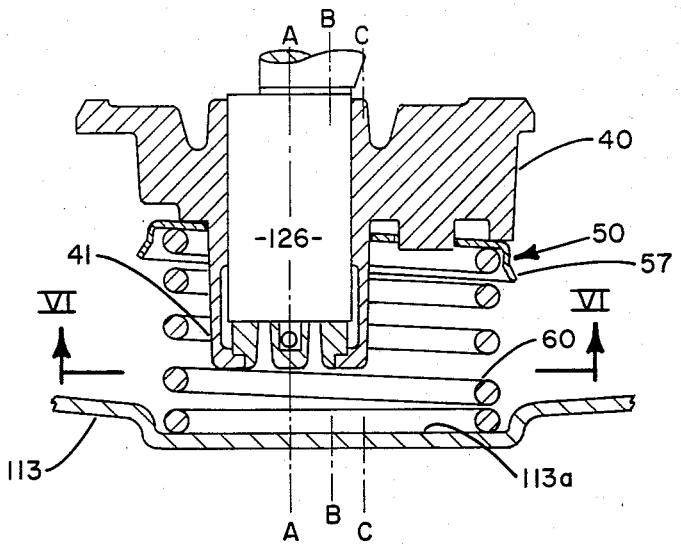
FIG. 5 is an enlarged partial sectional view corresponding to FIG. 2 showing the use of the present invention in a four-cylinder hermetic compressor.
Figure 6:
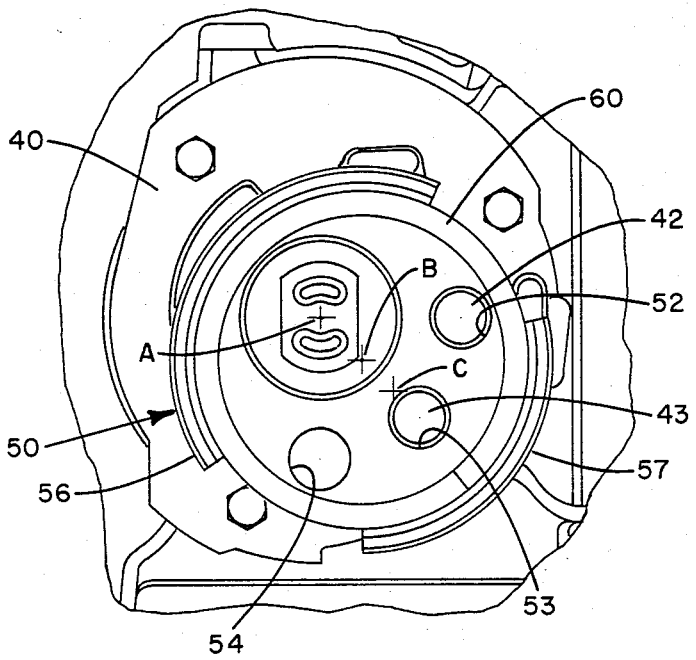
FIG. 6 is a sectional view taken along line VI—VI of FIG. 5.

In FIGS. 5 and 6 which correspond to FIGS. 2 and 3, respectively, the lower bearing head 40, positioning plate 50 and spring 60 are identical to those members described above with respect to FIGS. 1–3. The only difference in members 40, 50 and 60 is that plate 50 is located on bearing head 40 such that bosses 42 and 43 are received in openings 52 and 53, respectively. This configuration is different, because it is used with a four-cylinder hermetic compressor which has a different center of gravity from that of a two-cylinder hermetic compressor. All parts of the four-cylinder compressor are labeled 100 higher than the corresponding two-cylinder structure. The axes A—A, B—B and C—C and their point representation of A, B and C, respectively, represent the same features in FIGS. 5 and 6 that they do in FIGS. 1 and 2. It is thus seen that the same mounting structure can be used for compressors having their centers of gravity in different positions from each other.

In a compressor assembly employing the mounting structure of the present invention, the motor compressor unit is vertically supported by lower bearing head 40 which receives the crankshaft of the compressor. The lower bearing head 40 is vertically supported by positioning plate 50 which is in turn vertically supported by spring 60 which is received in a recess in the casing. Thus, the mounting structure comprising head 40, plate 50 and spring 60 coact to provide the sole vertical support of the motor compressor unit. This single vertical support is stable because the center of gravity of the compressor is coaxial with the centerline of the spring 60. Additionally, the locating of the centerline of the compressor within the area of the spring 60 further tends to stabilize this configuration. The plate 50 is provided with holes such that it can engage head 40 in a plurality of positions and head 40 is provided with rims 44 which coact with plate 50 to properly cant it in each of the positions of engagement.

Although a preferred embodiment of the present invention has been illustrated and described, other changes will occur to those skilled in the art. It is therefore intended that the present invention is to be limited only by the scope of the appended claims.

What is claimed is:

1. A mounting for vertically supporting an asymmetrical motor-compressor unit having a center of gravity spaced from the axis of rotation of the crankshaft within the shell of a hermetic compressor serially comprising:

bearing head means;

positioning plate means; and spring means;

said bearing head means being adapted to receive the crankshaft of a motor-compressor unit in a journal relationship and including an axial extension, a pair of axially extending bosses and at least one axially extending arcuate rim portion;

said positioning plate means having a first opening for receiving said axial extension and at least two additional openings for receiving said pair of bosses;

said spring means adapted to surround said axial extension and to biasingly engage said plate means and the shell and having a geometric center coaxial with the center of gravity of the compressor whereby a stable support is provided.

2. The mounting of claim 1 wherein said spring means is a single coil spring and said positioning plate means further includes means for retaining said spring means.

3. The mounting of claim 1 wherein said positioning plate means has three additional openings for receiving said pair of bosses in alternative pairs of openings.

4. In a hermetic compressor having a shell containing a motor-compressor unit with a crankshaft and said unit having its center of gravity spaced from the center of rotation of said crankshaft, mounting means for vertically supporting said motor-compressor unit within said shell comprising:

bearing head means engaging the bottom of said motor compressor unit and adapted to receive said crankshaft of said motor-compressor unit in a journal relationship and including an axial extension, a pair of axially extending bosses and at least one axially extending arcuate rim portion;

positioning plate means having a first opening for receiving said extension and at least two additional openings for receiving said pair of bosses;

spring means adapted to surround said extension and to engage said plate means and said shell such that the geometric center of said spring means is coaxial with said center of gravity of said motor compressor unit whereby a stable support is provided.

5. The hermetic compressor of claim 4 wherein said spring means is a single coil spring and said positioning plate means further includes means for retaining said spring means.

6. The hermetic compressor of claim 4 wherein said positioning plate means has three additional openings for receiving said pair of bosses in alternative pairs of openings.

* * * * *